US011667357B1

(12) United States Patent
Yi

(10) Patent No.: US 11,667,357 B1
(45) Date of Patent: Jun. 6, 2023

(54) POWER SURFBOARD

(71) Applicant: SHENZHEN FEILUN TECHNOLOGY CO., LTD., Shenzhen (CN)

(72) Inventor: Xiaodan Yi, Shenzhen (CN)

(73) Assignee: SHENZHEN FEILUN TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/095,713

(22) Filed: Jan. 11, 2023

(51) Int. Cl.

| | |
|---|---|
| ***B63B 32/10*** | (2020.01) |
| ***B63H 21/21*** | (2006.01) |
| ***B63B 32/40*** | (2020.01) |
| ***B63H 21/17*** | (2006.01) |

(52) U.S. Cl.
CPC ..... *B63B 32/10* (2020.02); *B63B 32/45* (2020.02); *B63H 21/17* (2013.01); *B63H 21/21* (2013.01); *B63H 2021/216* (2013.01)

(58) Field of Classification Search
CPC ..... B63B 32/10; B63B 32/45; B63H 21/21; B63H 21/17; B63H 2021/216
See application file for complete search history.

(56) References Cited

U.S. PATENT DOCUMENTS

| | | | | |
|---|---|---|---|---|
| 8,702,462 | B1 * | 4/2014 | Klokow | B63B 32/40 441/74 |
| 2012/0000409 | A1 * | 1/2012 | Railey | B63B 32/40 29/428 |
| 2013/0059489 | A1 * | 3/2013 | Vlock | B60L 50/66 440/6 |
| 2014/0134900 | A1 * | 5/2014 | Derrah | B63H 11/01 440/6 |
| 2021/0024179 | A1 * | 1/2021 | Weisenburger | B63B 32/10 |
| 2021/0114695 | A1 * | 4/2021 | Weisenburger | H01M 50/244 |
| 2021/0139114 | A1 * | 5/2021 | Lee | B63B 32/45 |

FOREIGN PATENT DOCUMENTS

| | | | | |
|---|---|---|---|---|
| AU | 2011272822 | A1 * | 12/2012 | B63B 35/79 |
| CN | 111976902 | A * | 11/2020 | B63B 32/10 |

* cited by examiner

*Primary Examiner* — S. Joseph Morano
*Assistant Examiner* — Jovon E Hayes
(74) *Attorney, Agent, or Firm* — Daniel M. Cohn; Howard M. Cohn

(57) ABSTRACT

A power surfboard includes a surfboard body defining a first side, a supporting piece including at least one first fastener, and a power assembly. An accommodating groove is defined on the first side of the surfboard body. The supporting piece is arranged in the accommodating groove. The power assembly includes a power housing, an operating assembly, and a power source. The operating assembly includes an operating body, at least one second fastener connected to inner side walls of the operating body, and at least one operating piece arranged on the operating body. The power assembly is detachably arranged in the accommodating groove. When each operating piece is in a first state, each second fastener is connected to a corresponding first fastener. When each operating piece is in a second state, each second fastener is separated from the corresponding first fastener.

10 Claims, 7 Drawing Sheets

POWER SURFBOARD

TECHNICAL FIELD

The present disclosure relates to a technical field of surfboards, and in particular to a power surfboard.

BACKGROUND

Surfing is one of water sports. Professional surfing generally refers to that an athlete is lying in a prone position on or kneeling on the surfboard, paddling to suitable waves, and then standing up and moving forward with the surfboard as the wave pushes the surfboard along at a fast glide. The professional surfing requires a relatively high professional skill, and needs to fully consider the situation of the waves. To enable surfing enthusiasts to enjoy pleasure of surfing on the premise of not having professional skills, electric surfboards are created. The electric surfboards are generally powered by a rechargeable battery, are easy to control, and are operated without considering the situation of the waves. Therefore, the surfing enthusiasts are able to freely slide on the sea by the electric surfboards and fully enjoy the pleasure of surfing.

However, the electric surfboards are powered by electricity and thus require frequent charging. The rechargeable battery of a conventional electric surfboard is usually fixed inside the conventional electric surfboard. When charging, the whole conventional electric surfboard needs to be carried to a power source to charge the rechargeable battery, which is time-consuming and laborious. Therefore, how to charge the rechargeable battery of the conventional electric surfboard quickly and easily is a problem that needs to be solved by those skilled in the art.

SUMMARY

In order to solve the problems in the prior art, the present disclosure provides a power surfboard that is fast and convenient to charge.

The power surfboard comprises a surfboard body, a supporting piece, and a power assembly. The surfboard body defines a first side. The surfboard body comprises an accommodating groove on the first side of the surfboard body. The supporting piece is arranged in the accommodating groove. At least one first fastener is arranged on the supporting piece. The power assembly comprises a power housing, an operating assembly, and a power source. The operating assembly comprises an operating body, at least one second fastener, and at least one operating piece. The at least one operating piece is movably arranged on the operating body. The at least one second fastener is connected to inner side walls of the operating body. The power assembly is detachably arranged in the accommodating groove.

When the at least one operating piece is in a first state, the at least one second fastener is connected to the at least one first fastener to limit the power assembly to be accommodated in the accommodating groove. When the at least one operating piece is switched from the first state to a second state, the at least one second fastener is separated from the at least one first fastener so as to take out the power assembly through the at least one operating piece.

In some embodiments, the at least one first fastener is integrally formed. The at least one first fastener comprises a bending portion, a first connecting portion, and a second connecting portion. The first connecting portion is connected to the bending portion and the second connecting portion. The first connecting portion is connected to the supporting piece. The second connecting portion is connected to an inner wall of the accommodating groove.

The at least one second fastener is integrally formed. The at least one second fastener comprises a transition portion, first abutting portions, a second abutting portion, and third abutting portions. The transition portion extends outwards to form the first abutting portions, the second abutting portion, and the third abutting portions. The first abutting portions are movably connected to two opposite inner side walls of the operating body.

When the at least one operating piece is in the first state, the third abutting portions do not contact the at least one operating piece, the second abutting portion hooks the bending portion, and the second abutting portion abuts against an inner side wall of the bending portion.

When the at least one operating piece is switched to the second state, the at least one operating piece abuts against the third abutting portions, and the at least one operating piece drives the at least one second fastener to rotate, so that the second abutting portion is separated from the bending portion.

In some embodiments, the operating body defines at least one recess and notches communicated with two ends of the recess. The at least one operating piece comprises a handle and pushing plates arranged on two ends of the handle.

When the at least one operating piece is in the first state, the handle is accommodated in the recess, and each of the pushing plates is accommodated in a corresponding notch.

When the at least one operating piece is switched to the second state, the handle is separated from the recess, and each of the pushing plates extends out of the corresponding notch and pushes a corresponding third abutting portion to rotate so as to drive the second abutting portion to be separated from the bending portion.

In some embodiments, the power housing comprises a cover plate and a power shell. The cover plate covers the power shell. The cover plate defines at least one first opening. A position of the at least one first opening corresponds to a position of the at least one operating piece.

The power shell defines a second opening. The power source and the operating assembly are accommodated in the power shell. A least part of the operating assembly and at least part of the power source are exposed from the second opening.

In some embodiments, a positioning block is arranged in the accommodating groove. The supporting piece is sleeved on the positioning block. The positioning block is configured to support the supporting piece.

In some embodiments, the power surfboard further comprises skeletons, and the surfboard body is integrally formed. The skeletons are embedded in the surfboard body.

In some embodiments, the power surfboard further comprises a control box, a motor, and an impeller. The motor defines a first end and a second end. The first end of the motor is connected to the control box. An output shaft is arranged on the second end of the motor. The motor is connected to the impeller through the output shaft.

The surfboard body further defines a second side opposite to the first side. The second side of the surfboard body defines a mounting groove. The accommodating groove defines a mounting opening. The mounting opening is communicated with the mounting groove. The impeller and the motor are arranged in the mounting groove. The control box is accommodated in the mounting opening.

In some embodiments, the power surfboard further comprises a power connector. The power connector is arranged on the control box and is electrically connected to the control box. The supporting piece defines through holes. The power connector passes through the through holes to electrically connect to the power source.

In some embodiments, the power surfboard further comprises a speed adjusting handle, an adjusting cord, and a mounting base. The mounting base is arranged on the first side of the surfboard body. The adjusting cord is connected to the mounting base and the speed adjusting handle. The adjusting cord is configured to adjust a distance between the speed adjusting handle and the mounting base. The speed adjusting handle is in communication connection with the control box. The speed adjusting handle is configured to control a speed of the power surfboard.

In some embodiments, foot fixing pieces and at least one auxiliary handle are arranged on the first side of the surfboard body. The foot fixing pieces are arranged adjacent to the accommodating groove.

Compared with the prior art, the power assembly of the present disclosure is detachably arranged in the surfboard body. When the power surfboard needs to be charged, the at least one operating piece is switched from the first state to the second state, and the at least one operating piece drives the at least one second fastener to rotate, so that the at least one second fastener is separated from the at least one first fastener. Therefore, the power assembly is able to be quickly taken out from the accommodation groove through the at least one operating piece. A user can separately charge the power assembly without moving the whole power surfboard, which is time-saving and labor-saving. When the power assembly needs to be mounted in the surfboard body, the power assembly in the second state is placed into the accommodating groove, and then the at least one operating piece is switched from the second state to the first state. At this time, the at least one operating piece does not contact the at least one second fastener, and the at least one second fastener is connected to the at least one first fastener, so that the power assembly is fixed in the accommodating groove.

Therefore, in the embodiments of the present disclosure, the at least one operating piece is able to switch between the first state and the second state, so as to fix the power assembly to the surfboard body or separate the power assembly from the surfboard body. Meanwhile, in the embodiments of the present disclosure, when the at least one operating piece is in the first state, the user can conveniently control the at least one operating piece to control the power assembly. For example, the power assembly can be moved to a position where the power assembly needs to be charged by holding the at least one operating piece. Compared with a design of the power assembly including both the at least one operating piece and a detachable connecting structure, the at least one operating piece of the embodiments of the present disclosure can be operated by the user and realizes connection and detachment of the power assembly, which is convenient for the user to control, realizes function Integration of the whole power surfboard, saves materials and processes to a certain extent, and save costs.

BRIEF DESCRIPTION OF DRAWINGS

Technical solutions and effects of the present disclosure will be apparent by following detailed descriptions of specific embodiments of the present disclosure, in conjunction with accompanying drawings.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

It should be understood in the description of the present disclosure that terms such as "upper", "lower", "front", "rear", "left", "right", "vertical", "horizontal", "top", "bottom", "inner", "outer", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

It is understood that the term "one" should be understood to mean "at least one" or "one or more", i.e., in one embodiment, the number of an element may be one, while in another embodiment, the number of the element may be more than one, and the term "one" cannot be understood as a limitation on the number.

It should be noted in the description of the present disclosure that, unless otherwise regulated and defined, terms such as "installation", "bonded", and "connection" shall be understood in broad sense, and for example, may refer to fixed connection or detachable connection or integral connection, may refer to mechanical connection or electrical connection, and may refer to direct connection or indirect connection through an intermediate medium or inner communication of two elements. For those of ordinary skill in the art, the meanings of the above terms in the present disclosure may be understood according to concrete conditions.

Figure 1:
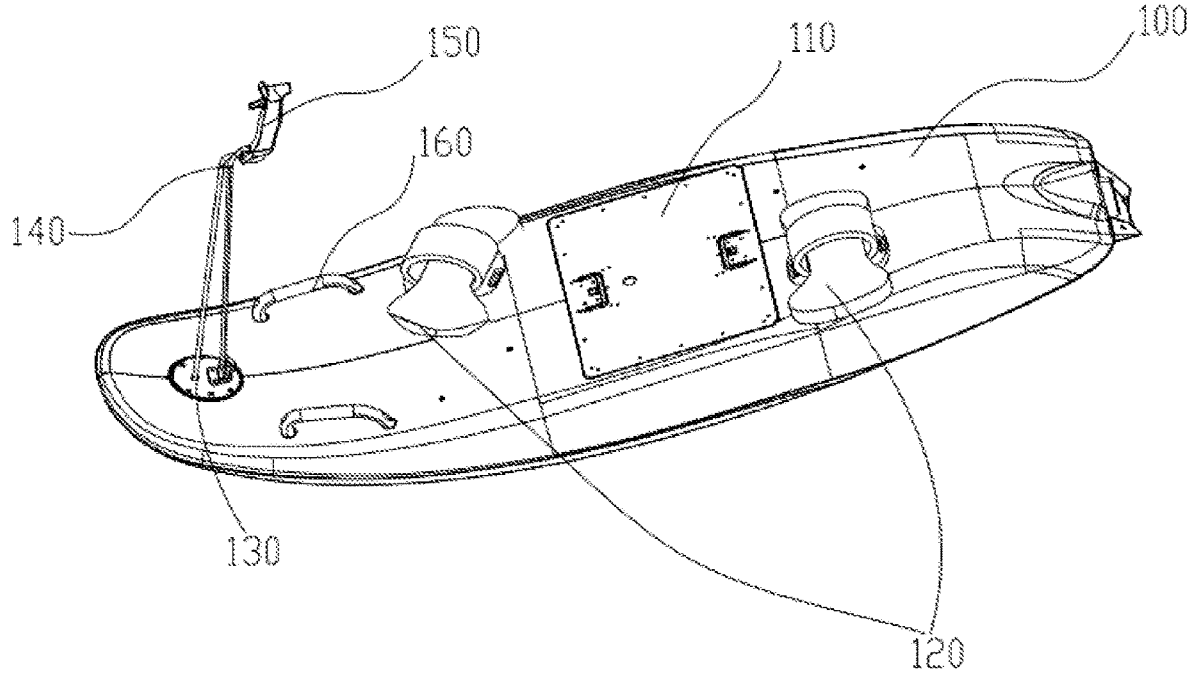
FIG. 1 is a perspective schematic diagram of a power surfboard according to one embodiment of the present disclosure.
Figure 2:
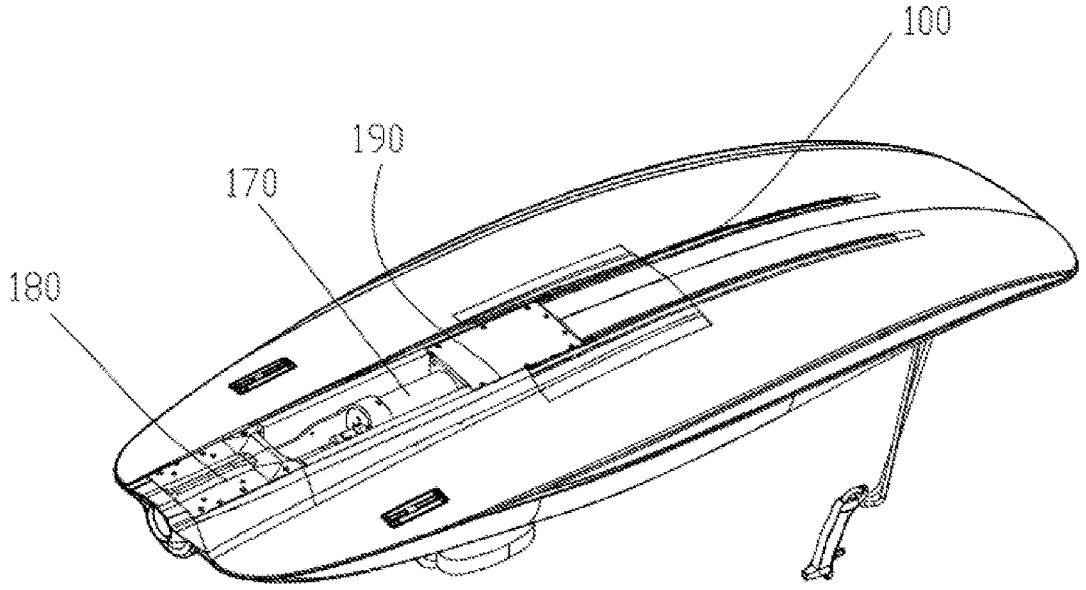
FIG. 2 is another perspective schematic diagram of the power surfboard according to one embodiment of the present disclosure.
Figure 3:
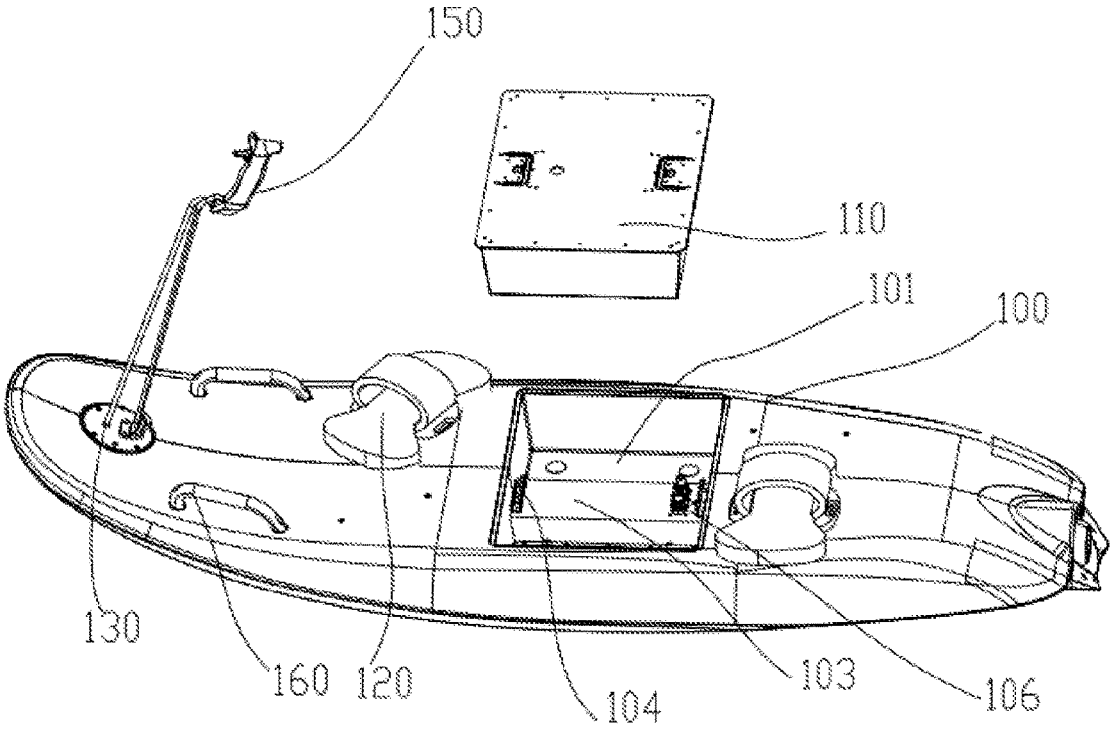
FIG. 3 is an exploded schematic diagram of the power surfboard according to one embodiment of the present disclosure.
Figure 4:
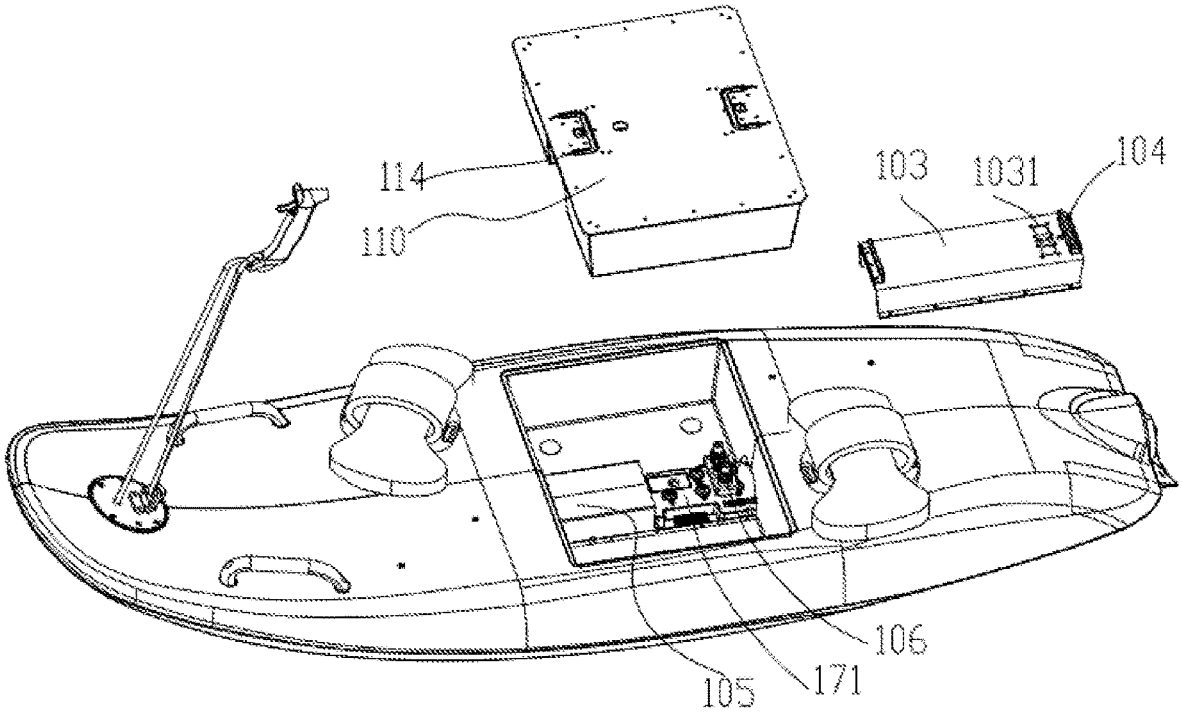
FIG. 4 is another exploded schematic diagram of the power surfboard according to one embodiment of the present disclosure.
Figure 5:
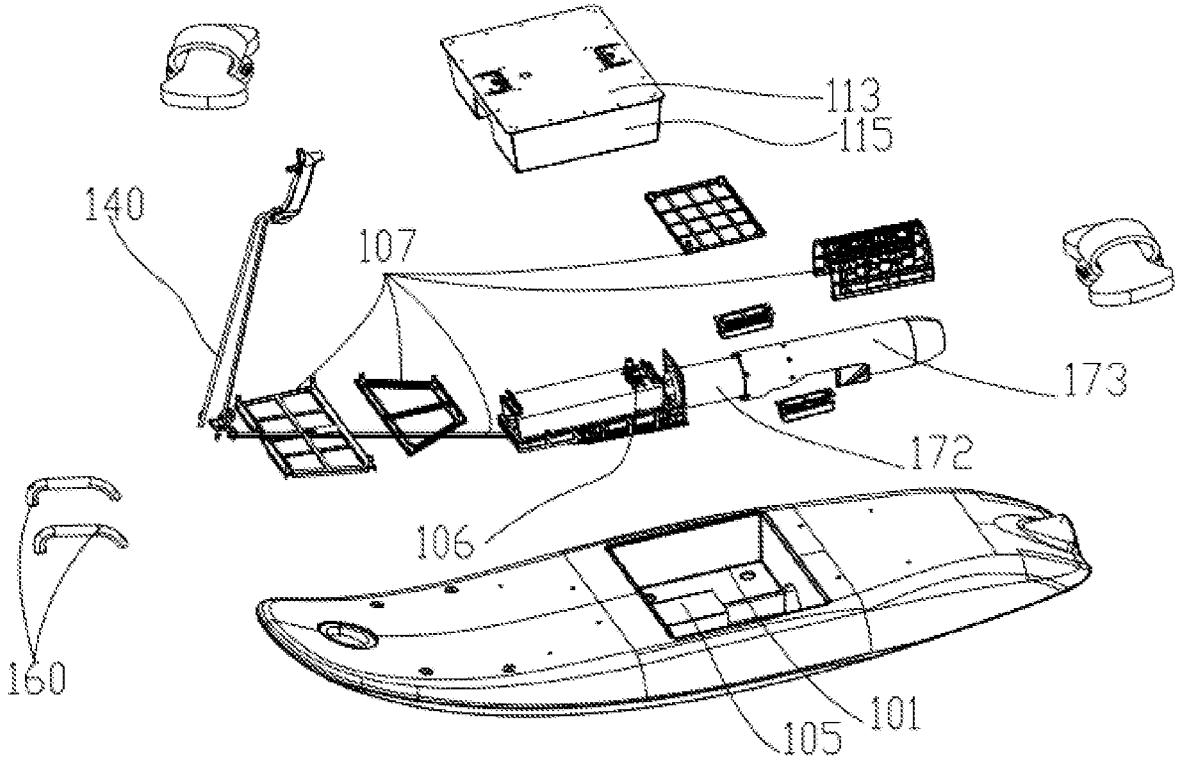
FIG. 5 is another exploded schematic diagram of the power surfboard according to one embodiment of the present disclosure.
Figure 6:
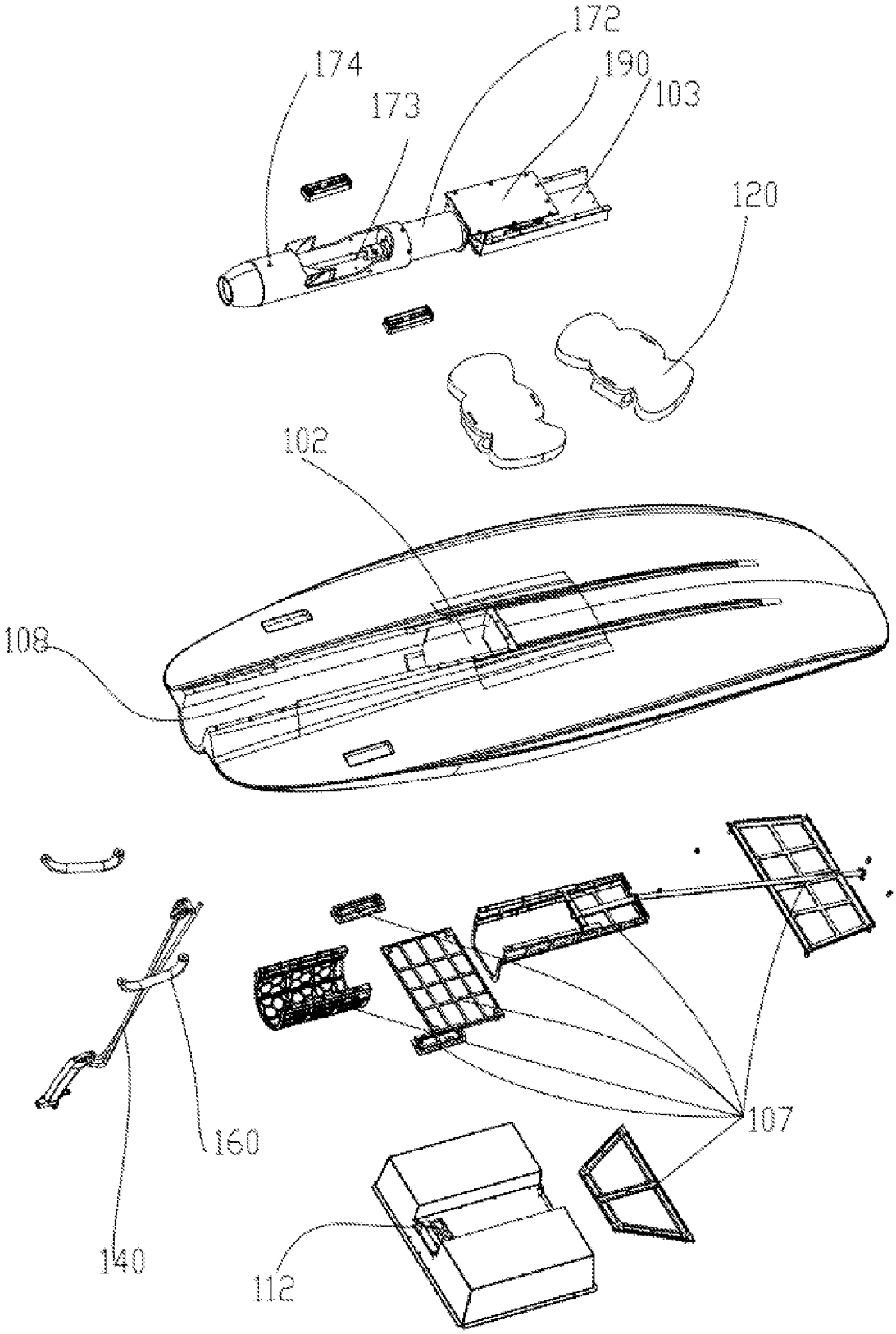
FIG. 6 is another exploded schematic diagram of the power surfboard according to one embodiment of the present disclosure.
Figure 7:
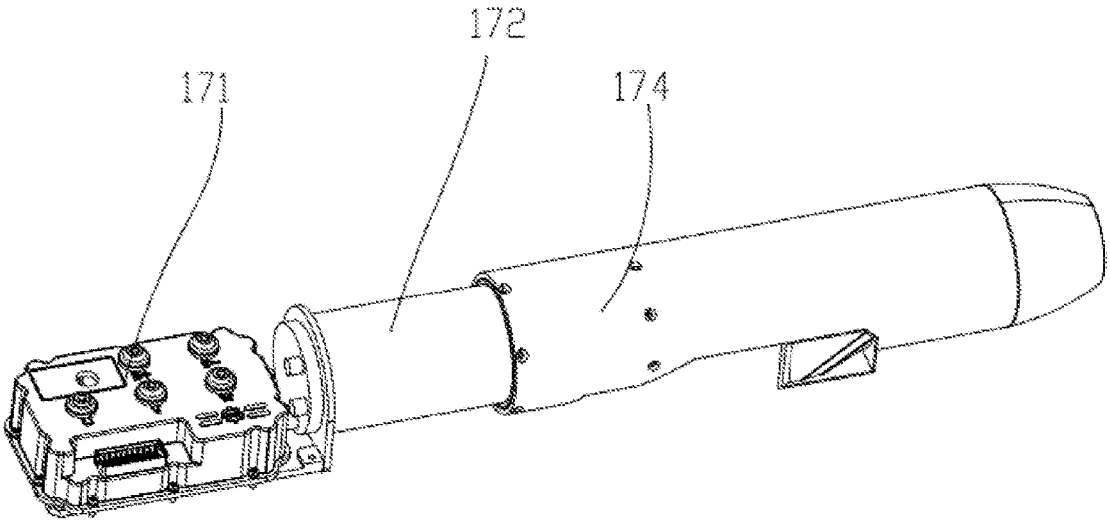
FIG. 7 is a perspective schematic diagram of a driving assembly according to one embodiment of the present disclosure.
Figure 8:
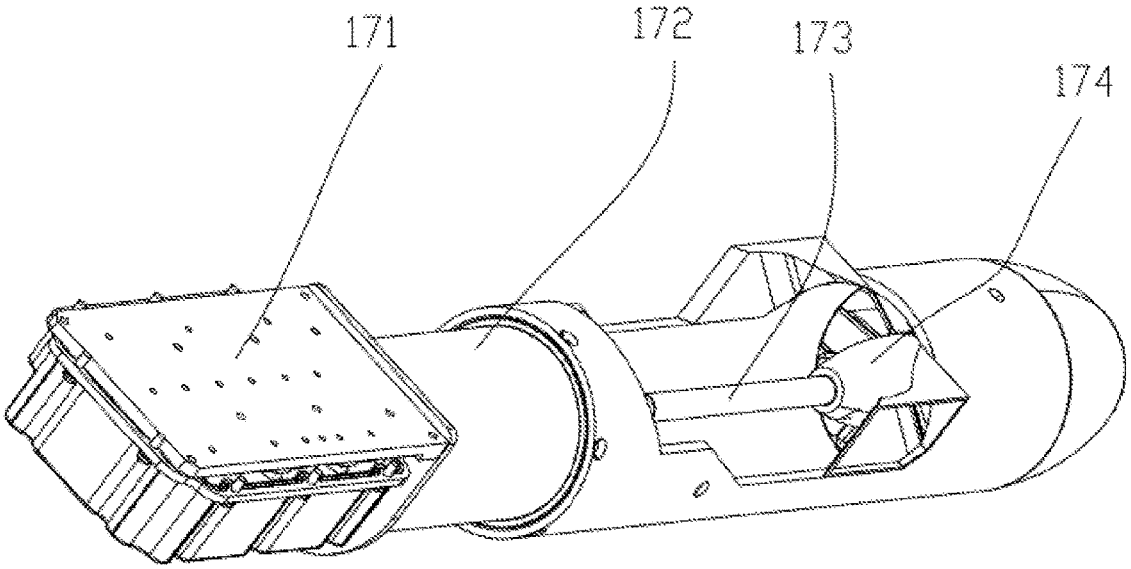
FIG. 8 is another perspective schematic diagram of the driving assembly according to one embodiment of the present disclosure.
Figure 9:
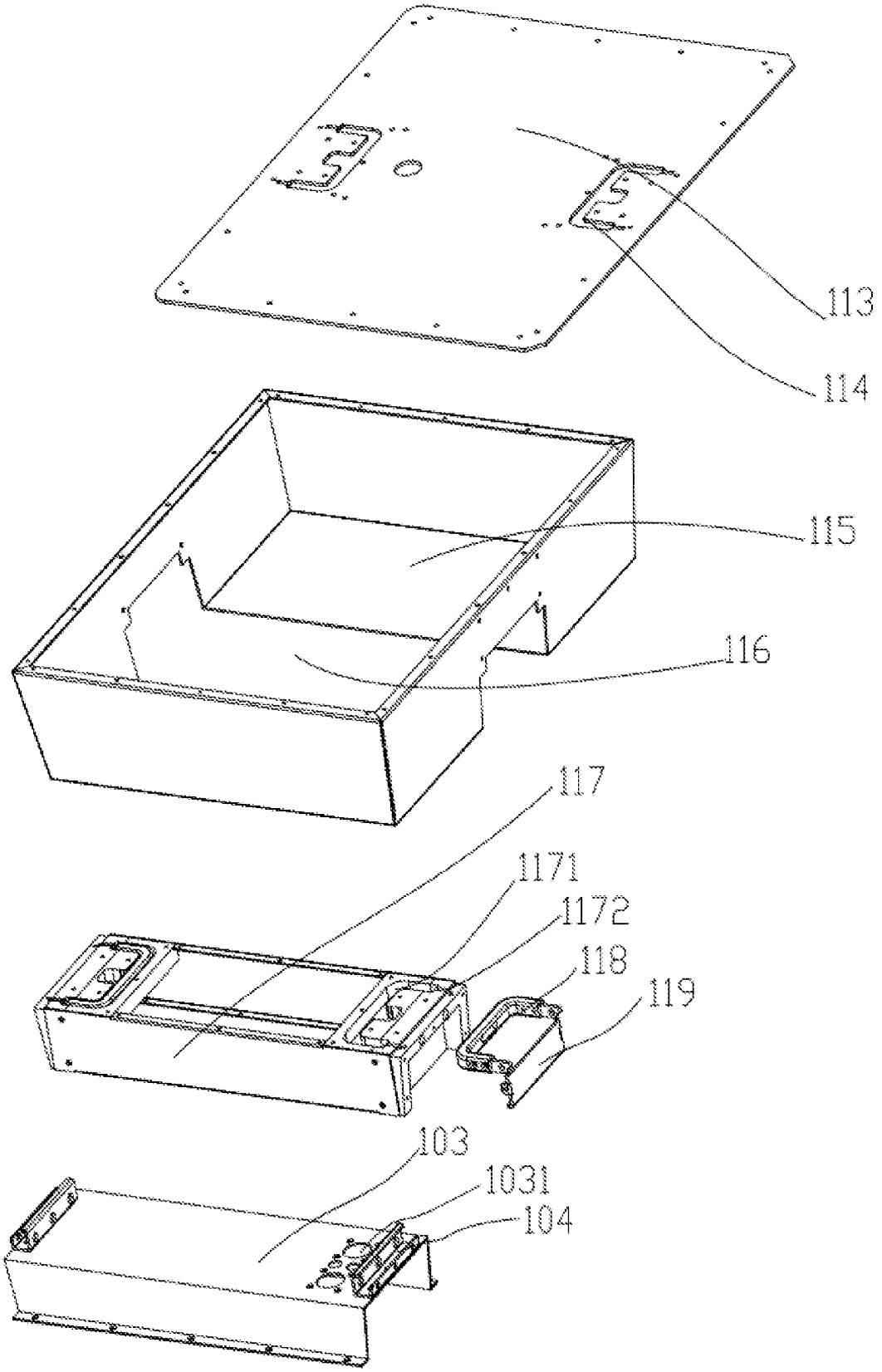
FIG. 9 is an exploded schematic diagram of a power assembly and a supporting piece according to one embodiment of the present disclosure.
Figure 10:
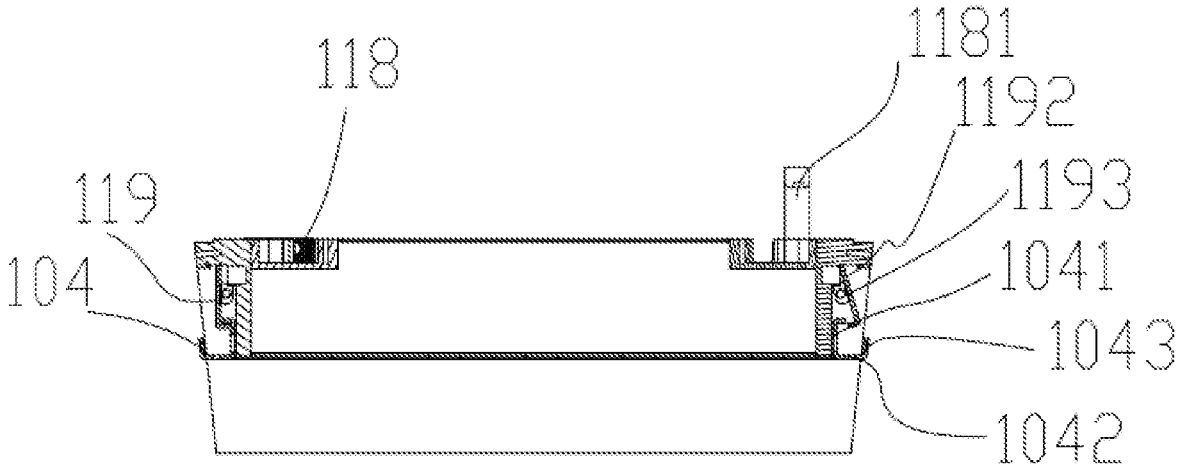
FIG. 10 is a cross-sectional schematic diagram of the power assembly and the supporting piece according to one embodiment of the present disclosure.
Figure 11:
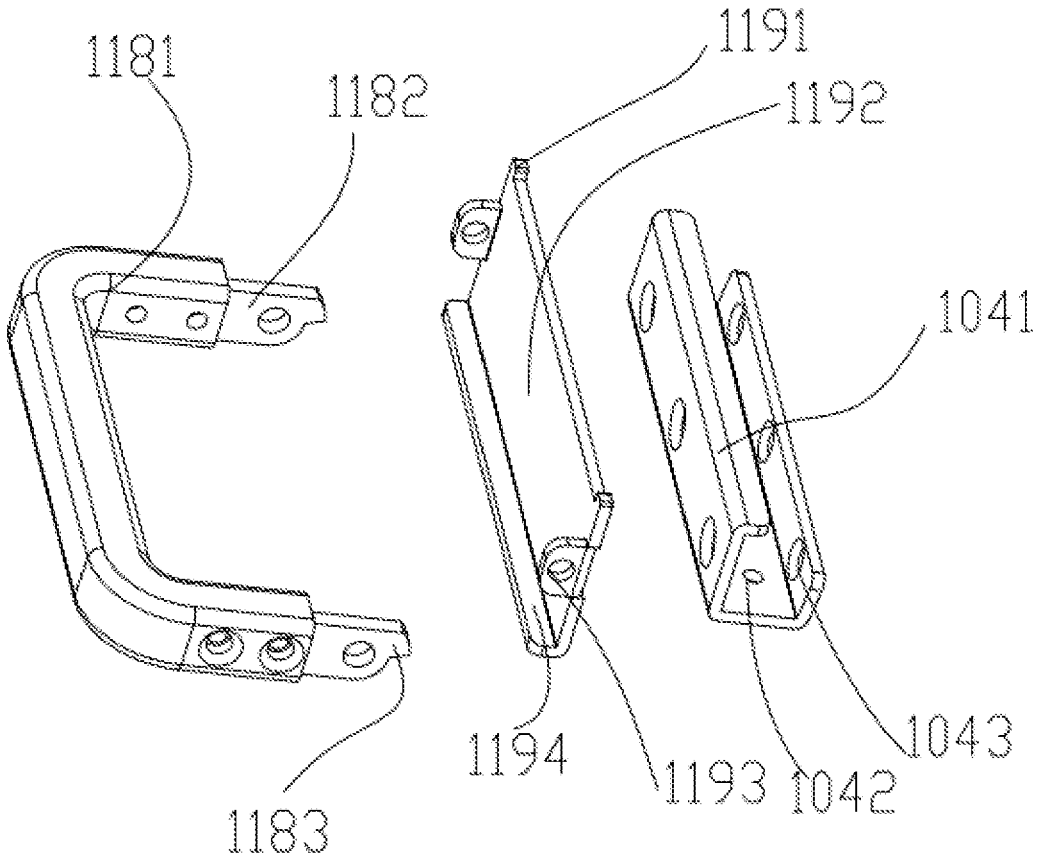
FIG. 11 is a schematic diagram of an operating piece, a first fastener, and a second fastener according to one embodiment of the present disclosure.

As shown in FIGS. 1-11, the present disclosure provide a power surfboard. The power surfboard comprises a surfboard body 100, a supporting piece 103, and a power assembly 110.

The surfboard body 100 defines a first side. The surfboard body comprises an accommodating groove 101 on the first side of the surfboard body 100. The supporting piece 103 is arranged in the accommodating groove 101. At least one first fastener 104 is arranged on the supporting piece 103. The power assembly 110 comprises a power housing 111, an operating assembly, and a power source 112. The operating assembly comprises an operating body 117 at least one second fastener 119, and at least one operating piece 118. The at least one operating piece 118 is movably arranged on the operating body 117. The at least one second fastener 119 is connected to inner side walls of the operating body 117. The power assembly 110 is detachably arranged in the accommodating groove 101.

When the at least one operating piece 118 is in a first state, the at least one second fastener 119 is connected to the at least one first fastener 104 to limit the power assembly 110 to be accommodated in the accommodating groove 101. When the at least one operating piece 118 is switched from the first state to a second state, the at least one second fastener 119 is separated from the at least one first fastener 104 so as to take out the power assembly 110 through the at least one operating piece 118.

In the embodiment, the power assembly 110 is a battery box. The power source 112 is a rechargeable battery, such as a lithium battery.

The power assembly 110 of the present disclosure is detachably arranged in the accommodating groove 101 of the surfboard body 100. When the power surfboard needs to be charged, the at least one operating piece 118 is switched from the first state to the second state, and the at least one operating piece 118 drives the at least one second fastener 119 to rotate, so that the at least one second fastener 119 is separated from the at least one first fastener 104. Therefore, the power assembly 110 is able to be quickly taken out from the accommodation groove 101 through the at least one operating piece 118. A user can separately charge the power assembly 110 without moving the whole power surfboard, which is time-saving and labor-saving. When the power assembly 110 needs to be mounted in the surfboard body 100, the power assembly 100 in the second state is placed into the accommodating groove 101, and then the at least one operating piece 118 is switched from the second state to the first state. At this time, the at least one operating piece 118 does not contact the at least one second fastener 119, and the at least one second fastener 119 is connected to the at least one first fastener 104, so that the power assembly 110 is fixed in the accommodating groove 101.

Therefore, in the embodiments of the present disclosure, the at least one operating piece 118 is able to switch between the first state and the second state, so as to fix the power assembly 110 to the surfboard body 100 or separate the power assembly 110 from the surfboard body 100. Meanwhile, in the embodiments of the present disclosure, when the at least one operating piece 118 is in the first state, the user can conveniently control the at least one operating piece 118 to control the power assembly 110. For example, the power assembly 110 can be moved to a position where the power assembly 110 needs to be charged by holding the at least one operating piece 118. Compared with a design of the power assembly including both the at least one operating piece and a detachable connecting structure, the at least one operating piece 118 of the embodiments of the present disclosure can be operated by the user and realizes connection and detachment of the power assembly 110, which is convenient for the user to control, realizes function Integration of the whole power surfboard, saves materials and processes to a certain extent, and save costs.

In some embodiments, the at least one first fastener 104 is integrally formed. The at least one first fastener 104 is a locking rack. The at least one first fastener 104 comprises a bending portion 1041, a first connecting portion 1042, and a second connecting portion 1043. The first connecting portion 1042 is connected to the bending portion 1041 and the second connecting portion 1043. The first connecting portion 1042 is connected to the supporting piece 103. The second connecting portion 1043 is connected to an inner wall of the accommodating groove 101. In the embodiment, the first connecting portion 1042 and the second connecting portion 1043 may be connected to the supporting piece 103 and the accommodating groove 101 by screws. Of course, the first connecting portion 1042 and the second connecting portion 1043 may also be connected to the supporting piece 103 and the accommodating groove 101 by other connecting structures, which is not limited thereto.

The at least one second fastener 119 is integrally formed. The at least one second fastener 119 is a locking plate. The at least one second fastener 119 comprises a transition portion 1192, first abutting portions 1193, a second abutting portion 1194, and third abutting portions 1191. The transition portion 1192 extends outwards to form the first abutting portions 1193, the second abutting portion 1194, and the third abutting portions 1191. The first abutting portions 1193 are movably connected to two opposite inner side walls of the operating body 117. In the embodiment, the first abutting portion 1193 may be connected to the operating body 117 through screws. Of course, the first abutting portion 1193 may also be connected to the operating body 117 through other connecting structures, which is not limited thereto.

When the at least one operating piece 118 is in the first state, the third abutting portions 1191 do not contact the at least one operating piece 118, the second abutting portion 1194 hooks the bending portion 1041, and the second abutting portion 1194 abuts against an inner side wall of the bending portion 1141. When the at least one operating piece 118 is switched to the second state, the at least one operating piece 118 abuts against the third abutting portions 1191, and the at least one operating piece 118 drives the at least one second fastener 119 to rotate, so that the second abutting portion 1194 is separated from the bending portion 1041.

In some embodiments, the operating body 117 defines at least one recess 1171 and notches 1172 communicated with two ends of the recess 1171. The at least one operating piece 118 comprises a handle 1181 and pushing plates 1182 arranged on two ends of the handle 1181. In the embodiment, the handle 1181 is an arcuate handle. The pushing plates 1182 may be fixedly connected to the handle 1181 by screws or welding.

When the at least one operating piece 118 is in the first state, the handle 1181 is accommodated in the recess 1171, and each of the pushing plates 1182 is accommodated in a corresponding notch 1172. When the at least one operating piece 118 is switched to the second state, the handle 1181 is separated from the recess 1171, and each of the pushing plates 1182 extends out of the corresponding notch 1172 and pushes a corresponding third abutting portion 1191 to rotate so as to drive the second abutting portion 1194 to be separated from the bending portion 1041. Specifically, in the embodiment, each of the pushing plates comprises a tooth portion 1183 extending outward. When each of the pushing plates 1182 extends out of the corresponding notch 1172, each tooth portion 1183 abuts against the corresponding third abutting portion 1192 and pushes the corresponding third abutting portion 1191 to rotate, thereby driving the second abutting portion 1194 to separate from the bending portion 1041. When the at least one operating piece 118 is switched from the second state to the first state, each tooth portion 1183 is separated from the corresponding third abutting portion 1192, and the at least one second fastener 119 resets under action of gravity.

In the embodiment, two first fasteners 104, two second fasteners 119, and two operating pieces are provided. The first fasteners 104 are symmetrically arranged on the supporting piece 103. The second fasteners 119 are symmetrically arranged on two sides of the operating body 117, and the operating pieces 118 are symmetrically arranged on the operating body 117.

In some embodiments, the power housing 111 comprises a cover plate 113 and a power shell 115. The cover plate 113 covers the power shell 115. The cover plate 113 defines at least one first opening 114. A position of the at least one first opening 114 corresponds to a position of the at least one operating piece 118. In the embodiment, a shape of the at least one first opening is matched with shapes of the recess are and the notches. The power shell 115 defines a second opening 116. The power source 112 and the operating assembly are accommodated in the power shell 115. A least part of the operating assembly and at least part of the power source 112 are exposed from the second opening 116.

In some embodiments, the power assembly 110 further comprises a power switch and a display panel (not shown in the drawings) arranged in the power shell 115. The cover plate comprises an interface for exposing the power switch and the display panel. The power switch and the display panel are electrically connected to the power source 112. The power switch is configured to turn on and turn off the power surfboard. The display panel is configured to display various parameters of the power surfboard, such as electric quantity, speed, available duration, and the like.

In some embodiments, a positioning block 105 is arranged in the accommodating groove 101. The supporting piece 103 is sleeved on the positioning block 105. The positioning block 105 is configured to support the supporting piece 103. In the embodiment, the supporting piece 103 is a supporting frame. The supporting frame is fixed in the accommodating groove 101 through screws. The positioning block 105 abuts against the supporting frame. The positioning block 105 is configured to position the supporting frame and prevent the supporting frame from deforming.

In some embodiments, the power surfboard further comprises skeletons 107. The surfboard body 100 is integrally formed. The skeletons 107 are embedded in the surfboard body 100.

Specifically, in the embodiment, the surfboard body 100 may be made of foaming material, such as expanded polypropylene (EPP). The skeletons 107 are embedded in different positions of the surfboard body 100 and have different shapes. Specifically, when producing, the skeletons 107 are placed in corresponding positions of a mold of the power surfboard and then the mold is filled with the foaming material. After the foaming material is cooled and solidified, the mold is opened to obtain the integrated surfboard body 100. Compared with a conventional power surfboard, since a conventional surfboard body of a conventional power surfboard is mostly made of carbon fibers or fiberglass, the conventional surfboard body is of a hollow structure. Various types of driving devices need to be fixed in the conventional surfboard body through various fixing structures, so that the conventional power surfboard consume more costs on mold opening and assembling than that of the present disclosure. Further, due to the conventional surfboard body is hollow, if the conventional surfboard body is damaged due to accidental collision during a surfing process, seawater is poured into the conventional power surfboard, which affects safety of the user. Moreover, since the material of the conventional surfboard body 100 made of carbon fibers or fiberglass is hard and brittle, once the conventional surfboard body is damaged, the whole conventional surfboard body needs to be replaced and the cost is high expensive.

In the embodiment, after the power surfboard is manufactured, the surfboard body 100 and the skeletons 107 are connected together in a solid structure, and the skeletons 107 support the surfboard body 100 to withstand tensile stress and shock resistance. When the user stands on the surfboard body 100, the surfboard body 100 uniformly transfers a weight of the user to the skeletons 107 to avoid deformation of the surfboard body 100. When an accidental collision occurs, the surfboard body 100 made of the foaming material buffers an impact force and uniformly transmits the force to the skeletons 107, so that the surfboard body 100 is not easily damaged. Even if a huge impact occurs and causes partial damage to the surfboard body 100 (for example, craters or broken corners, etc. are made), the partial damage does not affect the actual use of the surfboard body 100, so the user does not need to replace the whole surfboard body 100, which saves huge replacement costs.

Furthermore, the surfboard body 100 is also able to meet personalized needs of the user. The user is able to sleeve an encloser made of the carbon fibers or the fiberglass on the surfboard body 100 according to preferences, so that the power surfboard has an appearance similar to an appearance of the conventional power surfboard. Alternatively, the user can directly decorate the surfboard body 100, e.g., doodling, spray painting, or the like on the surfboard body 100, which is not limited thereto.

In some embodiments, the power surfboard further comprises a driving assembly 170. The driving assembly 170 is mounted in a linear pattern on the surfboard body 100. The driving assembly 170 comprises a control box 171, a motor 172, and an impeller 174. The motor 172 is defines a first end and a second end. The first end of the motor 172 is connected to the control box 171. An output shaft 173 is arranged on the second end of the motor 172. The motor 172 is connected to the impeller 174 through the output shaft 173. The surfboard body 100 further defines a second side opposite to the first side. The second side of the surfboard body defines a mounting groove 108. The accommodating groove 101 defines a mounting opening 102. The mounting opening 102 is communicated with the mounting groove 108. The impeller 174 and the motor 172 are arranged in the mounting groove 108. The control box 171 is accommodated in the mounting opening 102.

Through holes 1031 are defined on the supporting piece 103. A power connector 106 is arranged on and connected to the control box 171. The power connector 106 passes through the through holes 1031 and is electrically connected to the power source 112.

In the embodiment, the control box 171, the motor 172, and the impeller 174 are connected to form the driving assembly 170. When it is necessary to maintain an individual component of the driving assembly, the present disclosure hereby takes the control box 171 as an example. When the control box 171 needs to be repaired or replaced, the driving assembly 170 is detached. Then, the control box 171 is separately detached from the driving assembly 170. After maintenance is completed, the control box 171 is assembled with the motor 172 to be assembled into the driving assembly 170. Finally, the driving assembly 170 is mounted in the mounting groove 108 and the mounting opening 102. Since the mounting groove 108 and the mounting opening 102 do not have an extra active space for the driving assembly, if the control box 171 is detached and maintained separately without detaching the whole driving assembly 170, remaining components of the driving assembly 170 may occur displacement or structural damage of adjacent components of the control box may be made. After the driving assembly 170 is connected to a whole, the driving assembly 170 is convenient to assemble and disassemble. After the driving assembly 170 is detached, a disassembly space is not limited, and maintenance and replacement of the driving assembly is convenient.

Furthermore, in the embodiment, the mounting opening 102 is adjacent to the positioning block 105. The control box 171 is exposed from the mounting opening 102. When the supporting piece 103 covers the positioning block 105, the supporting piece 103 covers the power connector 106. The power connector 106 connected to the control box 171 passes through the through holes 1031 to electrically connect to the power source 112. The power connector 106 comprises a positive electrode and a negative electrode. The power source 112 provides power for the control box 171. The control box 171 is electrically connected to the motor 172. When the motor 172 rotates, the output shaft 173 is driven to rotate to drive the impeller 174 to rotate. The impeller 174 rotates to discharge seawater, thereby pushing the power surfboard to surf on the sea.

In some embodiments, the power surfboard further comprises a pressing plate 180 and a mounting plate 190. The mounting plate 190 is mounted on the mounting opening. The pressing plate 180 is mounted on the mounting groove 108. The mounting plate 190 is connected to the control box 171. The mounting plate 190 is configured to mount the control box 171. The pressing plate 180 is mounted on a position of the mounting groove corresponding to the pressing plate 180. The pressing plate 180 limits the position of the impeller 174 and protects the impeller 174.

In some embodiments, the power surfboard further comprises a speed adjusting handle 150, an adjusting cord 140, and a mounting base 130. The mounting base 130 is arranged on the first side of the surfboard body 100. The adjusting cord 140 is connected to the mounting base 130 and the speed adjusting handle 150. The adjusting cord 140 is configured to adjust a distance between the speed adjusting handle 150 and the mounting base 130. The speed adjusting handle 150 is in communication connection with the control box 171. The speed adjusting handle is configured to control a speed of the power surfboard.

In the embodiment, the adjusting cord 140 may be a nylon cord or an elastic cord. When the adjusting cord 140 is the nylon cord, a length of the adjusting cord 140 may be adjusted in a knotting manner, or the length of the adjusting cord 140 may be adjusted by a connecting piece such as a buckle, which is not limited thereto. When the adjusting cord 140 is an elastic cord, the length of the adjusting cord 140 may be adjusted according to a force applied by the user, so as to adjust the distance between the mounting base 130 and the speed adjusting handle 150.

In some embodiments, foot fixing pieces 120 and at least one auxiliary handle 150 are arranged on the first side of the surfboard body 100. The foot fixing pieces 120 are arranged adjacent to the accommodating groove 101.

In the embodiment, two foot fixing pieces 120 are provided. The foot fixing pieces 120 may be foot fixing sleeves, and the user can directly extend feet into the foot fixing sleeves to complete fixing of the feet. The foot fixing pieces 120 are disposed relative to two sides of the accommodating groove 101. In the surfing process, the user can insert the feet into the foot fixing sleeves respectively, so that the user is prevented from separating from the power surfboard, and the safety of the user is ensured. Of course, the foot fixing pieces 120 may be fixing belts or shoe-shaped supports, which are not limited thereto, as long as the feet of the user can be fixed thereto.

In the embodiment, two auxiliary handles 150 are provided. The two auxiliary handles 150 are symmetrically disposed on a front portion of the first side of the surfboard body 100. The auxiliary handles 150 are configured to assist the user to board the power surfboard.

Technical features of the above-mentioned embodiments can be combined arbitrarily. For the sake of brevity, all possible combinations of the technical features in the above-mentioned embodiments are not described. However, as long as there is no contradiction between the combinations of these technical features, the combinations should be considered to be within the scope of the specification.

The above-mentioned embodiments only represent some embodiments of the present disclosure. The descriptions thereof are specific and detailed, but should not be construed as a limitation of the scope of the present disclosure. It should be pointed out that for those of ordinary skill in the art, without departing from the concept of the present disclosure, modifications and improvements can be made. The modifications and the improvements belong to the protection scope of the present disclosure. Therefore, the protection scope of the present disclosure should be subject to the attached claims.

What is claimed is:

1. A power surfboard, comprising:

a surfboard body, a supporting piece, and a power assembly;

wherein the surfboard body defines a first side; the surfboard body comprises an accommodating groove on the first side of the surfboard body;

wherein the supporting piece is arranged in the accommodating groove; at least one first fastener is arranged on the supporting piece;

wherein the power assembly comprises a power housing, an operating assembly, and a power source; the operating assembly comprises an operating body, at least one second fastener, and at least one operating piece; the at least one operating piece is movably arranged on the operating body; the at least one second fastener is connected to inner side walls of the operating body; the power assembly is detachably arranged in the accommodating groove;

when the at least one operating piece is in a first state, the at least one second fastener is connected to the at least one first fastener to limit the power assembly to be accommodated in the accommodating groove; and when the at least one operating piece is switched from the first state to a second state, the at least one second fastener is separated from the at least one first fastener so as to take out the power assembly through the at least one operating piece.

2. The power surfboard according to claim 1, wherein the at least one first fastener is integrally formed; the at least one first fastener comprises a bending portion, a first connecting portion, and a second connecting portion; the first connecting portion is connected to the bending portion and the second connecting portion; the first connecting portion is connected to the supporting piece; the second connecting portion is connected to an inner wall of the accommodating groove;

wherein the at least one second fastener is integrally formed; the at least one second fastener comprises a transition portion, first abutting portions, a second abutting portion, and third abutting portions; the transition portion extends outwards to form the first abutting portions, the second abutting portion, and the third abutting portions; the first abutting portions are movably connected to two opposite inner side walls of the operating body;

when the at least one operating piece is in the first state, the third abutting portions do not contact the at least one operating piece, the second abutting portion hooks the bending portion, and the second abutting portion abuts against an inner side wall of the bending portion;

when the at least one operating piece is switched to the second state, the at least one operating piece abuts against the third abutting portions, and the at least one operating piece drives the at least one second fastener to rotate, so that the second abutting portion is separated from the bending portion.

3. The power surfboard according to claim 2, wherein the operating body defines at least one recess and notches communicated with two ends of the recess; the at least one operating piece comprises a handle and pushing plates arranged on two ends of the handle;

when the at least one operating piece is in the first state, the handle is accommodated in the recess, and each of the pushing plates is accommodated in a corresponding notch;

when the at least one operating piece is switched to the second state, the handle is separated from the recess, and each of the pushing plates extends out of the corresponding notch and pushes a corresponding third abutting portion to rotate so as to drive the second abutting portion to separate from the bending portion.

4. The power surfboard according to claim 1, wherein the power housing comprises a cover plate and a power shell; the cover plate covers the power shell; the cover plate defines at least one first opening; a position of the at least one first opening corresponds to a position of the at least one operating piece;

wherein the power shell defines a second opening; the power source and the operating assembly are accommodated in the power shell; at least part of the operating assembly and at least part of the power source are exposed from the second opening.

5. The power surfboard according to claim 1, wherein a positioning block is arranged in the accommodating groove; the supporting piece is sleeved on the positioning block; the positioning block is configured to support the supporting piece.

6. The power surfboard according to claim 1, wherein the power surfboard further comprises skeletons; the surfboard body is integrally formed; the skeletons are embedded in the surfboard body.

7. The power surfboard according to claim 1, wherein the power surfboard further comprises a control box, a motor, and an impeller; the motor defines a first end and a second end; the first end of the motor is connected to the control box; an output shaft is arranged on the second end of the motor; the motor is connected to the impeller through the output shaft;

wherein the surfboard body further defines a second side opposite to the first side; the second side of the surfboard body defines a mounting groove; the accommodating groove defines a mounting opening; the mounting opening is communicated with the mounting groove; the impeller and the motor are arranged in the mounting groove; the control box is accommodated in the mounting opening.

8. The power surfboard according to claim 7, wherein the power surfboard further comprises a power connector; the power connector is arranged on the control box and is electrically connected to the control box; the supporting piece defines through holes; the power connector passes through the through holes to electrically connect to the power source.

9. The power surfboard according to claim 7, wherein the power surfboard further comprises a speed adjusting handle, an adjusting cord, and a mounting base; the mounting base is arranged on the first side of the surfboard body; the adjusting cord is connected to the mounting base and the speed adjusting handle; the adjusting cord is configured to adjust a distance between the speed adjusting handle and the mounting base; the speed adjusting handle is in communication connection with the control box; the speed adjusting handle is configured to control a speed of the power surfboard.

10. The power surfboard according to claim 1, wherein foot fixing pieces and at least one auxiliary handle are arranged on the first side of the surfboard body; the foot fixing pieces are arranged adjacent to the accommodating groove.

* * * * *